US007972482B2

(12) United States Patent
Strack et al.

(10) Patent No.: US 7,972,482 B2
(45) Date of Patent: Jul. 5, 2011

(54) METHOD FOR PROCESSING HYDROCARBON PYROLYSIS EFFLUENT

(75) Inventors: Robert David Strack, Houston, TX (US); John R. Messinger, Kingwood, TX (US)

(73) Assignee: ExxonMobile Chemical Patents Inc., Houston, TX (US)

( * ) Notice: Subject to any disclaimer, the term of this patent is extended or adjusted under 35 U.S.C. 154(b) by 0 days.

(21) Appl. No.: 12/785,758

(22) Filed: May 24, 2010

(65) Prior Publication Data

US 2010/0230235 A1 Sep. 16, 2010

Related U.S. Application Data

(63) Continuation of application No. 11/177,975, filed on Jul. 8, 2005, now Pat. No. 7,749,372.

(51) Int. Cl.
*C10B 27/00* (2006.01)

(52) U.S. Cl. ..... 196/134

(58) Field of Classification Search ..... 196/134
See application file for complete search history.

(56) References Cited

U.S. PATENT DOCUMENTS

| | | | | | |
|---|---|---|---|---|---|
| 2,102,947 | A | * | 12/1937 | Eaton | 585/330 |
| 2,343,192 | A | | 2/1944 | Kuhn | |
| 2,695,264 | A | | 11/1954 | Taff et al. | |
| 2,901,418 | A | | 8/1959 | Pappas | |
| 2,945,076 | A | * | 7/1960 | Pardee | 585/648 |
| 2,951,029 | A | * | 8/1960 | Johnston et al. | 208/100 |
| 3,060,116 | A | | 10/1962 | Hardin, Jr. et al. | |
| 3,154,482 | A | * | 10/1964 | Cahn et al. | 208/101 |
| 3,498,906 | A | | 3/1970 | Bogart et al. | |
| 3,529,030 | A | | 9/1970 | Chin | |
| 3,593,968 | A | | 7/1971 | Geddes | |
| 3,647,907 | A | | 3/1972 | Sato et al. | |
| 3,676,519 | A | | 7/1972 | Dorn et al. | |
| 3,907,661 | A | | 9/1975 | Gwyn et al. | |
| 3,923,921 | A | * | 12/1975 | Kohfeldt | 585/634 |
| 3,959,420 | A | | 5/1976 | Geddes et al. | |
| 4,042,488 | A | * | 8/1977 | Perciful | 208/102 |
| 4,107,226 | A | | 8/1978 | Ennis, Jr. et al. | |
| 4,121,908 | A | | 10/1978 | Raab et al. | |
| 4,150,716 | A | | 4/1979 | Ozaki et al. | |
| 4,166,830 | A | | 9/1979 | Guth et al. | |
| 4,233,137 | A | | 11/1980 | Ozaki et al. | |
| 4,279,733 | A | | 7/1981 | Gwyn | |
| 4,279,734 | A | | 7/1981 | Gwyn | |
| 4,420,343 | A | | 12/1983 | Sliwka | |
| 4,444,697 | A | | 4/1984 | Gater et al. | |
| 4,446,003 | A | | 5/1984 | Burton et al. | |
| 4,457,364 | A | | 7/1984 | DiNicolantonio et al. | |
| 4,520,760 | A | | 6/1985 | Covell | |
| 4,581,899 | A | | 4/1986 | von Klock et al. | |
| 4,614,229 | A | | 9/1986 | Oldweiler | |
| 4,702,818 | A | | 10/1987 | Oyamoto et al. | |
| 4,945,978 | A | | 8/1990 | Herrmann | |
| 5,092,981 | A | | 3/1992 | Russo | |
| 5,107,921 | A | | 4/1992 | Tsai | |
| 5,139,650 | A | | 8/1992 | Lenglet | |
| 5,147,511 | A | | 9/1992 | Woebcke | |
| 5,215,649 | A | | 6/1993 | Grenoble et al. | |
| 5,271,827 | A | | 12/1993 | Woebcke | |
| 5,294,347 | A | | 3/1994 | Byrne et al. | |
| 5,324,486 | A | | 6/1994 | Russo | |
| 5,579,831 | A | | 12/1996 | Brucher | |
| 5,690,168 | A | | 11/1997 | Cizmar et al. | |
| 5,756,055 | A | | 5/1998 | Kelly et al. | |
| 6,148,908 | A | | 11/2000 | Brucher | |
| 6,183,626 | B1 | | 2/2001 | Lenglet et al. | |
| 6,271,431 | B1 | | 8/2001 | Busson et al. | |
| 6,626,424 | B2 | | 9/2003 | Ngan et al. | |
| 2003/0031612 | A1 | | 2/2003 | Raynal et al. | |

FOREIGN PATENT DOCUMENTS

| | | |
|---|---|---|
| EP | 0 031 609 | 7/1981 |
| EP | 0 205 205 | 12/1986 |
| EP | 1 063 273 | 12/2000 |
| GB | 1233795 | 5/1971 |
| GB | 1309309 | 3/1973 |
| GB | 1390382 | 4/1975 |
| JP | 2001-40366 | 2/2001 |
| WO | WO 93/12200 | 6/1993 |
| WO | WO 97/13097 | 4/1997 |
| WO | WO 00/56841 | 9/2000 |

OTHER PUBLICATIONS

Lohr et al., "Steam-Cracker Economy Keyed to Quenching," Oil Gas Journal, vol. 76 (No. 20), pp. 63-68 (1978).

Kister, H.Z., Distillation Design, Chapter 6 "*Tray Design and Operation*," pp. 259-363. Chapter 8 "*Packing Design and Operation*," pp. 421-521, McGraw-Hill, Inc. Copyright (1992).

Herrmann, H. & Burghardt, W., "*Latest Developments in Transfer Line Exchanger Design for Ethylene Plants*", Apr. 1994, Schmidt' sche-Heissdampf-Gesellschaft, pp. 193-228.

Mukherjee, R., "*Effectively Design Shell-and-Tube Heat Exchangers*", 94 Chem. Engr. Progress, pp. 21-37, (1998).

* cited by examiner

*Primary Examiner* — Glenn Caldarola
*Assistant Examiner* — Randy Boyer

(57) ABSTRACT

A method is disclosed for treating the effluent from a hydrocarbon pyrolysis unit without employing a primary fractionator. The method comprises passing the gaseous effluent to at least one primary heat exchanger, thereby cooling the gaseous effluent and generating high pressure steam, and then cooling the gaseous effluent to a temperature at which tar, formed by reactions among constituents of the effluent, condenses. The gaseous effluent and the condensed tar are fed to at least one knock-out drum, whereby the tar is separated from the gaseous effluent. The gaseous effluent is then further cooled to condense a pyrolysis gasoline fraction from the effluent and to reduce the temperature of the effluent to a point at which it can be compressed efficiently. The condensed pyrolysis gasoline fraction is separated from the effluent and then distilled so as to reduce its final boiling point.

7 Claims, 4 Drawing Sheets

METHOD FOR PROCESSING HYDROCARBON PYROLYSIS EFFLUENT

CROSS REFERENCE TO RELATED APPLICATIONS

This application is a continuation of U.S. patent application Ser. No. 11/177,975, filed Jul. 8, 2005 now U.S. Pat. No. 7,749,372, and is fully incorporated herein by reference. The present application expressly incorporates by reference herein the entire disclosures of application Ser. No. 11/178,158, entitled "Method For Cooling Hydrocarbon Pyrolysis Effluent", application Ser. No. 11/177,125, entitled "Method For Processing Hydrocarbon Pyrolysis Effluent", application Ser. No. 11/177/075, entitled "Method For Processing Hydrocarbon Pyrolysis Effluent", application Ser. No. 11/178,037, entitled "Method For Processing Hydrocarbon Pyrolysis Effluent", and application Ser. No. 11/178,025, entitled "Method For Processing Hydrocarbon Pyrolysis Effluent", all of which are incorporated herein by reference and concurrently filed with the present application.

FIELD OF THE INVENTION

The present invention is directed to a method for processing the gaseous effluent from hydrocarbon pyrolysis units.

BACKGROUND OF THE INVENTION

The production of light olefins (ethylene, propylene and butenes) from various hydrocarbon feedstocks utilizes the technique of pyrolysis, or steam cracking. Pyrolysis involves heating the feedstock sufficiently to cause thermal decomposition of the larger molecules. The pyrolysis process, however, produces molecules which tend to combine to form high molecular weight materials known as tars. Tars are high-boiling point, viscous, reactive materials that can foul equipment under certain conditions.

The formation of tars, after the pyrolysis effluent leaves the steam cracking furnace can be minimized by rapidly reducing the temperature of the effluent exiting the pyrolysis unit to a level at which the tar-forming reactions are greatly slowed.

One technique used to cool pyrolysis unit effluent and remove the resulting heavy oils and tars employs heat exchangers followed by a water quench tower in which the condensibles are removed. This technique has proven effective when cracking light gases, primarily ethane, propane and butane, because crackers that process light feeds, collectively referred to as gas crackers, produce relatively small quantities of tar. As a result, heat exchangers can efficiently recover most of the valuable heat without fouling and the relatively small amount of tar can be separated from the water quench albeit with some difficulty.

This technique is, however, not satisfactory for use with steam crackers that crack naphthas and heavier feedstocks, collectively referred to as liquid crackers, since liquid crackers generate much larger quantities of tar than gas crackers. Heat exchangers can be used to remove some of the heat from liquid cracking, but only down to the temperature at which tar begins to condense. Below this temperature, conventional heat exchangers cannot be used because they would foul rapidly from accumulation and thermal degradation of tar on the heat exchanger surfaces. In addition, when the pyrolysis effluent from these feedstocks is quenched, some of the heavy oils and tars produced have approximately the same density as water and can form stable oil/water emulsions. Moreover, the larger quantity of heavy oils and tars produced by liquid cracking would render water quench operations ineffective, making it difficult to raise steam from the condensed water and to dispose of excess quench water and the heavy oil and tar in an environmentally acceptable manner.

Accordingly in most commercial liquid crackers, cooling of the effluent from the cracking furnace is normally achieved using a system of transfer line heat exchangers, a primary fractionator, and a water quench tower or indirect condenser. For a typical naphtha feedstock, the transfer line heat exchangers cool the process stream to about 700° F. (370° C.), efficiently generating super-high pressure steam that can be used elsewhere in the process. The primary fractionator is normally used to condense and separate the tar from the lighter liquid fraction, known as pyrolysis gasoline, and to recover the heat between about 700° F. (370° C.) and about 200° F. (90° C.). The water quench tower or indirect condenser further cools the gas stream exiting the primary fractionator to about 104° F. (40° C.) to condense the bulk of the dilution steam present and to separate pyrolysis gasoline from the gaseous olefinic product, which is then sent to a compressor.

The primary fractionator, however, is a very complex piece of equipment that typically includes an oil quench section, a primary fractionator tower and one or more external oil pumparound loops. At the quench section, quench oil is added to cool the effluent stream to about 400 to 6504° F. (200 to 343° C.), thereby condensing tar present in the stream. In the primary fractionator tower, the condensed tar is separated from the remainder of the stream, heat is removed in one or more pumparound zones by circulating oil and a pyrolysis gasoline fraction is separated from heavier material in one or more distillation zones. In the one or more external pumparound loops, oil, which is withdrawn from the primary fractionator, is cooled using indirect heat exchangers and then returned to the primary fractionator or the direct quench point.

The primary fractionator with its associated pumparounds is the most expensive component in the entire cracking system. The primary fractionator tower itself is the largest single piece of equipment in the process, typically being about twenty-five feet in diameter and over a hundred feet high for a medium size liquid cracker. The tower is large because it is in effect fractionating two minor components, tar and pyrolysis gasoline, in the presence of a large volume of low pressure gas. The pumparound loops are likewise large, handling over 3 million pounds per hour of circulating oil in the case of a medium size cracker. Heat exchangers in the pumparound circuit are necessarily large because of high flow rates, close temperature approaches needed to recover the heat at useful levels, and allowances for fouling.

In addition, the primary fractionator has a number of other limitations and problems. In particular, heat transfer takes place twice, i.e., from the gas to the pumparound liquid inside the tower and then from the pumparound liquid to the external cooling service. This effectively requires investment in two heat exchange systems, and imposes two temperature approaches (or differentials) on the removal of heat, thereby reducing thermal efficiency.

Moreover, despite the fractionation that takes place between the tar and gasoline streams, both streams often need to be processed further. Sometimes the tar needs to be stripped to remove light components, whereas the gasoline may need to be refractionated to meet its end point specification.

Further, the primary fractionator tower and its pumparounds are prone to fouling. Coke accumulates in the bottom section of the tower and must eventually be removed during plant turnarounds. The pumparound loops are also subject to fouling, requiring removal of coke from filters and periodic cleaning of fouled heat exchangers. Trays and packing in the tower are sometimes subject to fouling, potentially limiting plant production. The system also contains a significant inventory of flammable liquid hydrocarbons, which is not desirable from an inherent safety standpoint.

There is therefore a need for a simplified method for cooling pyrolysis unit effluent and removing the resulting heavy oils and tars which obviates the need for a primary fractionator tower and its ancillary equipment.

U.S. Pat. Nos. 4,279,733 and 4,279,734 propose cracking methods using a quencher, indirect heat exchanger and fractionator to cool effluent, resulting from steam cracking.

U.S. Pat. Nos. 4,150,716 and 4,233,137 propose a heat recovery apparatus comprising a pre-cooling zone where the effluent resulting from steam cracking is brought into contact with a sprayed quenching oil, a heat recovery zone, and a separating zone.

Lohr et al., "Steam-cracker Economy Keyed to Quenching," Oil & Gas Journal, Vol. 76 (No. 20), pp. 63-68, (1978), proposes a two-stage quenching involving indirect quenching with a transfer line heat exchanger to produce high-pressure steam along with direct quenching with a quench oil to produce medium-pressure steam.

U.S. Pat. Nos. 5,092,981 and 5,324,486 propose a two-stage quench process for effluent resulting from steam cracking furnace comprising a primary transfer line exchanger which functions to rapidly cool furnace effluent and to generate high temperature steam and a secondary transfer line exchanger which functions to cool the furnace effluent to as low a temperature as possible consistent with efficient primary fractionator or quench tower performance and to generate medium to low pressure steam.

U.S. Pat. No. 5,107,921 proposes transfer line exchangers having multiple tube passes of different tube diameters. U.S. Pat. No. 4,457,364 proposes a close-coupled transfer line heat exchanger unit.

U.S. Pat. No. 3,923,921 proposes a naphtha steam cracking process comprising passing effluent through a transfer line exchanger to cool the effluent and thereafter through a quench tower.

WO 93/12200 proposes a method for quenching the gaseous effluent from a hydrocarbon pyrolysis unit by passing the effluent through transfer line exchangers and then quenching the effluent with liquid water so that the effluent is cooled to a temperature in the range of 220° F. to 266° F. (105° C. to 130° C.), such that heavy oils and tars condense, as the effluent enters a primary separation vessel. The condensed oils and tars are separated from the gaseous effluent in the primary separation vessel and the remaining gaseous effluent is passed to a quench tower where the temperature of the effluent is reduced to a level at which the effluent is chemically stable.

EP 205 205 proposes a method for cooling a fluid such as a cracked reaction product by using transfer line exchangers having two or more separate heat exchanging sections.

U.S. Pat. No. 5,294,347 proposes that in ethylene manufacturing plants, a water quench column cools gas leaving a primary fractionator and that in many plants, a primary fractionator is not used and the feed to the water quench column is directly from a transfer line exchanger.

JP 2001-40366 proposes cooling mixed gas in a high temperature range with a horizontal heat exchanger and then with a vertical heat exchanger having its heat exchange planes installed in the vertical direction. A heavy component condensed in the vertical exchanger is thereafter separated by distillation at downstream refining steps.

WO 00/56841; GB 1,390,382; GB 1,309,309; and U.S. Pat. Nos. 4,444,697; 4,446,003; 4,121,908; 4,150,716; 4,233,137; 3,923,921; 3,907,661; and 3,959,420; propose various apparatus for quenching a hot cracked gaseous stream wherein the hot gaseous stream is passed through a quench pipe or quench tube wherein a liquid coolant (quench oil) is injected.

SUMMARY OF THE INVENTION

In one aspect, the present invention is directed to a method for treating gaseous effluent from a hydrocarbon pyrolysis unit, the method comprising:

(a) cooling the gaseous effluent to or slightly below a temperature at which tar, formed by reaction among constituents of the effluent, condenses;

(b) passing the mixed gaseous and liquid effluent from (a) through at least one knock-out drum, where the condensed tar separates from the gaseous effluent;

(c) cooling the gaseous effluent from (b) to condense a pyrolysis gasoline fraction from said effluent and reduce the temperature of the gaseous effluent to less than 212° F. (100° C.), for example less than 167° F. (75° C.), typically less than 140° F. (60° C.), and in one embodiment between about 68 and 122° F. (20-50° C.);

(d) separating the pyrolysis gasoline fraction condensed in (c); and then (e) distilling said separated pyrolysis gasoline fraction so as to reduce the final boiling point of said pyrolysis gasoline fraction.

In a further aspect, the present invention is directed to a method for treating gaseous effluent from a hydrocarbon pyrolysis unit, the method comprising:

(a) passing the gaseous effluent through at least one primary heat exchanger, thereby cooling the gaseous effluent and generating high pressure steam;

(b) passing the gaseous effluent from (a) through at least one secondary heat exchanger having a heat exchange surface maintained at a temperature such that part of the gaseous effluent condenses to form a liquid coating on said surface, for example when said heat exchange surface is maintained at a temperature below about 599° F. (315° C.);

(c) passing the mixed gaseous and liquid effluent from (b) through at least one knock-out drum, where tar, formed by reaction among constituents of the effluent and condensed in (b), separates from the effluent;

(d) cooling the gaseous effluent from (c) to condense a pyrolysis gasoline fraction from said effluent and reduce the temperature of the gaseous effluent to less than 212° F. (100° C.); and (e) separating the pyrolysis gasoline fraction condensed in (d); and then (f) distilling said separated pyrolysis gasoline fraction so as to reduce the final boiling point of said pyrolysis gasoline fraction.

In yet a further aspect, the present invention is directed to a hydrocarbon cracking apparatus comprising:

(a) a reactor for pyrolyzing a hydrocarbon feedstock, the reactor having an outlet through which gaseous pyrolysis effluent can exit the reactor;

(b) at least one heat exchanger connected to and downstream of the reactor outlet for cooling the gaseous effluent;

(c) at least one knock-out drum connected to and downstream of the at least one heat exchanger for separating tar from the gaseous effluent;

(d) a cooling train connected to and downstream of the at least one knock-out drum for further cooling the gaseous effluent so as to condense a pyrolysis gasoline fraction from said effluent and reduce the temperature of the gaseous effluent to less than 212° F. (100° C.);

(e) a separator for removing said pyrolysis gasoline fraction from said gaseous effluent; and (f) a fractionator for fractionating said pyrolysis gasoline fraction into a heavy fraction and a light fraction having a lower final boiling point than that of said pyrolysis gasoline fraction.

DETAILED DESCRIPTION OF THE EMBODIMENTS

Figure 1:
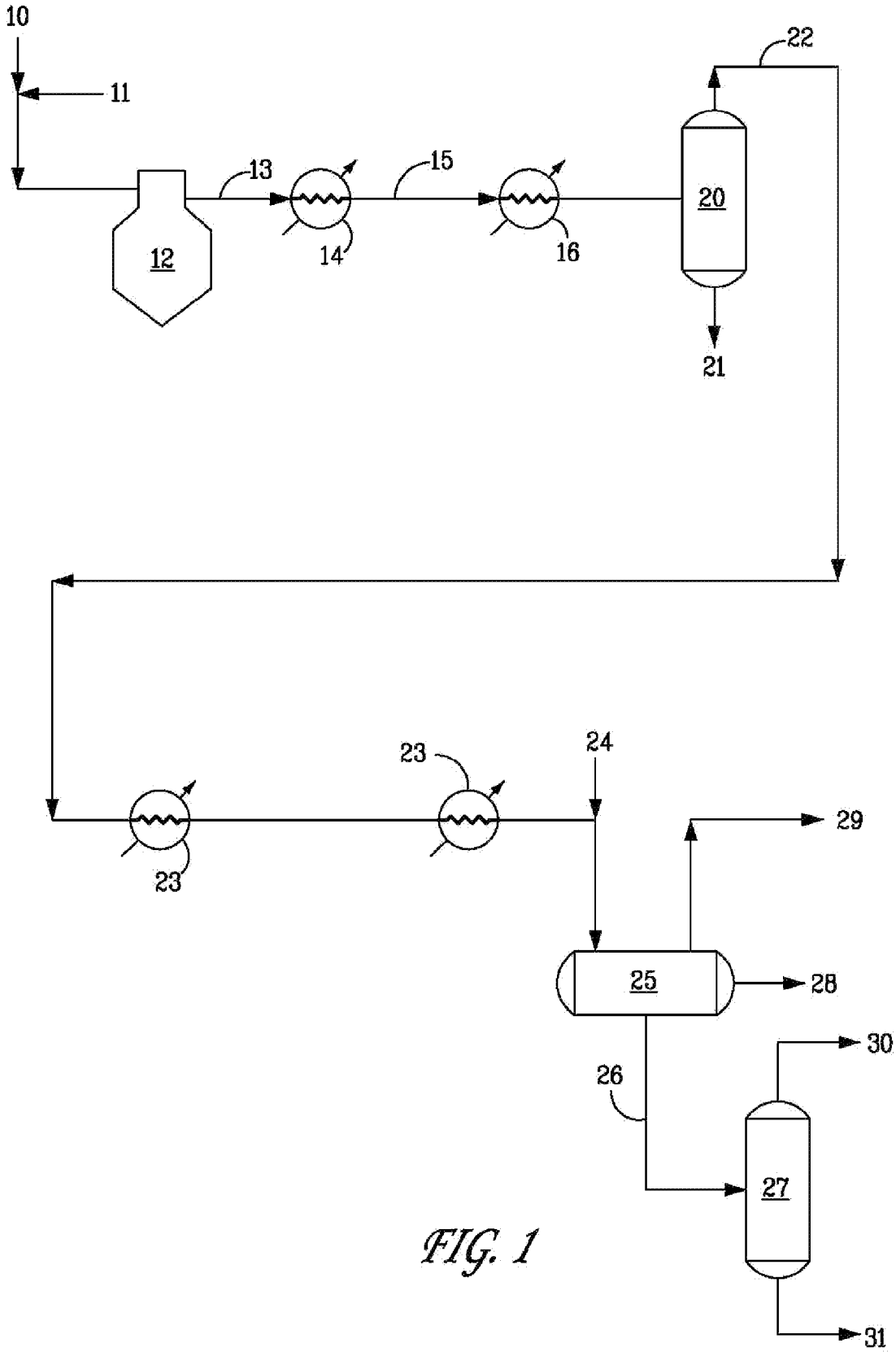
FIG. 1 is a schematic flow diagram of a method according to a first example of the present invention of treating the gaseous effluent from the liquid cracking of a naphtha feed.

The present invention provides a low cost way of treating the gaseous effluent stream from a hydrocarbon pyrolysis reactor so as to remove and recover heat therefrom and to separate $C_5$+ hydrocarbons from the desired $C_2$-$C_4$ olefins in the effluent, without the need for a primary fractionator.

Typically, the effluent used in the method of the invention is produced by pyrolysis of a hydrocarbon feed boiling in a temperature range from about 104° F. to about 1200° F. (40° C. to about 650° C.), such as light naphtha or gas oil. The temperature of the gaseous effluent at the outlet from the pyrolysis reactor is normally in the range of about 1400° F. to about 1706° F. (760° C. to about 930° C.) and the invention provides a method of cooling the effluent to a temperature at which the desired $C_2$-$C_4$ olefins can be compressed efficiently, generally less than 212° F. (100° C.), for example less than 167° F. (75° C.), such as less than 140° F. (60° C.) and typically 68° F. to 122° F. (20 to 50° C.).

In one embodiment, the present method comprises passing the effluent through at least one heat exchanger, such as a primary transfer line heat exchanger, capable of recovering heat down to a temperature where fouling is incipient. If needed, this heat exchanger can be periodically cleaned by steam decoking, steam/air decoking, or mechanical cleaning. Conventional indirect heat exchangers, such as tube-in-tube exchangers or shell and tube exchangers, may be used in this service to generate steam, preheat boiler feed water, or otherwise recover heat for a useful purpose.

Conveniently, a secondary heat exchanger, such as a secondary transfer line heat exchanger, is also provided and is operated such that it includes a heat exchange surface cool enough to condense part of the effluent and generate a liquid hydrocarbon film at the heat exchange surface. The liquid film is generated in situ and preferably at or below the temperature at which tar is produced, typically at about 302° F. to about 599° F. (150° C. to about 315° C.), such as at about 446° F. (230° C.). This is ensured by proper choice of cooling medium and exchanger design. Because the main resistance to heat transfer is between the bulk process stream and the film, the film can be at a significantly lower temperature than the bulk stream. The film effectively keeps the heat exchange surface wetted with fluid material as the bulk stream is cooled, thus preventing fouling. Such a secondary, or wet, transfer line exchanger must cool the process stream continuously to the temperature at which tar is produced. If the cooling is stopped before this point, fouling is likely to occur because the process stream would still be in the fouling regime. This secondary transfer line exchanger is particularly suitable for use with light liquid feeds, such as naphtha.

After passage through the transfer line heat exchanger(s), the cooled effluent is fed to a tar knock-out drum where the condensed tar is separated from the effluent stream. If desired, multiple knock-out drums may be connected in parallel such that individual drums can be taken out of service and cleaned while the plant is operating. The tar removed at this stage of the process typically has an initial boiling point of at least 400° F. (200° C.).

The effluent entering the tar knock-out drum(s) should be at a sufficiently low temperature, typically at about 374° F. to about 599° F. (190° C. to about 315° C.), such as at about 446° F. (230° C.), that the tar separates rapidly in the knock-out drum(s). Thus, depending on the severity of operation of the transfer line heat exchanger(s), the effluent stream, after it passes from the heat exchanger(s) and before it enters the tar knock-out drum, can be further cooled by direct injection of a small amount of water.

After removal of the tar in the tar knock-out drum(s), the gaseous effluent stream is subjected to an additional cooling sequence by which additional heat energy is recovered from the effluent and the temperature of the effluent is reduced to a point at which the lower olefins in the effluent can be efficiently compressed, typically 68° F. to 122° F. (20 to 50° C.) and preferably about 104° F. (40° C.). The additional cooling sequence includes passing the effluent through one or more cracked gas coolers and then through either a water quench tower or at least one indirect partial condenser so as to condense the pyrolysis gasoline and water in the effluent. The condensate is then separated into an aqueous fraction and a pyrolysis gasoline fraction and the pyrolysis gasoline fraction is distilled to lower its final boiling point. Typically, the pyrolysis gasoline fraction condensed from the effluent stream has an initial boiling point of less than 302° F. (150° C.) and final boiling point in excess of 500° F. (260° C.), such as of the order of 842° F. (450° C.) whereas, after distillation, it typically has a final boiling point of 356 to 446° F. (180 to 230° C.).

It will therefore be seen that in the method of the invention, the pyrolysis effluent is cooled to a temperature at which the lower olefins in the effluent can be efficiently compressed without undergoing a fractionation step. Thus the method of the invention obviates the need for a primary fractionator, the most expensive component of the heat removal system of a conventional naphtha cracking unit. As a result, the pyrolysis gasoline fraction contains some heavier components than would not have been present if the entire gaseous effluent had been passed through a primary fractionator. However, these heavier components are removed in a simple distillation tower (typically including 15 trays, a reboiler and a condenser) that can be constructed and operated at a fraction of the cost of a conventional primary fractionator.

The method of the invention achieves several advantages in addition to the reduced capital and operating costs associated with removal of the primary fractionator. The use of at least one primary transfer line heat exchanger and at least one secondary transfer line heat exchanger maximizes the value of recovered heat. Further, additional useful heat is recovered after the tar is separated out. Tar and coke are removed from the process as early as possible in a dedicated vessel, minimizing fouling and simplifying coke removal from the process. Liquid hydrocarbon inventory is greatly reduced and pumparound pumps are eliminated. Fouling of primary fractionator trays and pumparound exchangers is eliminated. Safety valve relieving rates and associated flaring in the event of a cooling water or power failure may be reduced.

Where the additional cooling sequence involves passing the effluent through at least one indirect partial condenser, this is conveniently arranged to lower the temperature of the effluent to about 68° F. to about 122° F. (20° C. to about 50° C.), typically about 104° F. (40° C.). By operating at such a low temperature, as compared with the temperature of about 176° F. (80° C.) normally achieved with a water quench tower, additional light hydrocarbons can condense, thereby reducing the density of the hydrocarbon phase and improving the separation of pyrolysis gasoline from water. Such separation typically occurs in a settling drum.

To further reduce the density of the condensed hydrocarbon, an embodiment of the present invention contemplates the addition of light pyrolysis gasoline to the condensed pyrolysis gasoline stream. Several light fractions of pyrolysis gasoline are normally produced in a naphtha steam cracker, for example, a fraction containing mainly $C_5$ and light $C_6$ components and a benzene concentrate fraction. These fractions have lower densities than that of the total condensed pyrolysis gasoline stream. Adding such a stream to the condensed pyrolysis gasoline stream will lower its density, thereby improving separation of the hydrocarbon phase from the water phase. The ideal recycle fraction will maximize the reduction in density of the condensed pyrolysis gasoline with minimal vaporization. It may be added directly to the quench water settler or to an upstream location.

In one embodiment of the invention, the low level heat removed from the gas effluent in the cracked gas cooler(s) is used to heat deaerator feed water. Typically demineralized water and steam condensate are heated to about 266° F. (130° C.) using low pressure steam in a deaerator where air is stripped out. To achieve effective stripping, the maximum temperature of the water entering the deaerator is generally limited to 20° F. to 50° F. (11° to 28° C.) below the deaerator temperature, depending on the design of the deaerator system. This allows water to be heated to 212° to 239° F. (100 to 115° C.) using indirect heat exchange with the cooling cracked gas stream. Cooling water exchangers could be used as needed to supplement cooling of the cracked gas stream. By way of example, in one commercial olefins plant, about 816 klb/hr of demineralized water at 84° F. (29° C.) and 849 klb/hr of steam condensate at 167° F. (75° C.) are currently heated to 268° F. (131° C.) using 242 klb/hr of low pressure steam. These streams could potentially be heated to 241° F. (116° C.) using heat recovered from cracked gas. This would reduce the deaerator steam requirement from 242 klb/hr to 46 klb/hr, for a saving of 196 klb/hr of low pressure steam, and would reduce the cooling tower duty by about 189 MBTU/hr.

In an embodiment of the invention, particularly for use with heavier feeds, such as gas oils, a second knock-out drum can be provided in the cooling sequence downstream of the tar knock-out drums to separate additional oil from the gas stream. The second knock-out drum is preferably operated at a temperature above the dew point of water, typically at about 200° F. to about 302° F. (90° C. to about 150° C.), such as at about 248° F. (120° C.), to produce a light oil fraction having an initial boiling point in the range of about 194° F. (90° C.) to about 392° F. (200° C.).

The invention will now be more particularly described with reference to the examples shown in the accompanying drawings.

Referring to FIG. 1, in the method of the first example a hydrocarbon feed 10 comprising naphtha and dilution steam 11 is fed to a steam cracking reactor 12 where the hydrocarbon feed is heated to cause thermal decomposition of the feed to produce lower molecular weight hydrocarbons, such as $C_2$-$C_4$ olefins. The pyrolysis process in the steam cracking reactor also produces some molecules which tend to react to form tar.

Gaseous pyrolysis effluent 13 exiting the steam cracking reactor 12 initially passes through at least one primary heat exchanger 14 which cools the process stream to a temperature between about 644° F. and about 1202° F. (340° C. and about 650° C.), such as about 700° F. (370° C.), using water as the cooling medium and which generates super-high pressure steam, typically at about 1500 psig (10400 kPa).

On leaving the primary heat exchanger 14, the cooled gaseous effluent stream 15 is still at a temperature above the hydrocarbon dew point (the temperature at which the first drop of liquid condenses) of the effluent. Above the hydrocarbon dew point, the fouling tendency is relatively low, i.e., vapor phase fouling is generally not severe, and there is no liquid present that could cause fouling.

After leaving the primary heat exchanger 14, the gaseous effluent stream 15 is cooled to a temperature between about 302° F. and about 599° F. (150° C. and about 315° C.), for example about 446° F. (230° C.), such that the tar in the effluent condenses. This cooling may be achieved by means of a conventional oil or water quench (not shown) or more preferably by passing the effluent through a secondary heat exchanger, which is indicated at 16 in FIG. 1 and which is discussed in more detail with reference to FIG. 2.

After cooling the gaseous effluent to or slightly below the temperature at which the tar condenses, the effluent is passed into at least one tar knock-out drum 20 where the effluent is separated into a tar and coke fraction 21 and a gaseous fraction 22. Thereafter, the gaseous fraction 22 passes through one or more cracked gas coolers 23, where the fraction is cooled to a temperature of about 68° F. to about 122° F. (20° C. to about 50° C.), such as about 104° F. (40° C.) by indirect heat transfer first with deaerator feed water and then with cooling water as the cooling media. The cooled effluent, containing condensed pyrolysis gasoline and water, is then mixed with a light pyrolysis gasoline stream 24 and passed to a quench water settling drum 25. In the drum 25, the condensate separates into a hydrocarbon fraction 26, which is fed a distillation tower 27, an aqueous fraction 28, which is fed to a sour water stripper (not shown), and a gaseous overhead fraction 29, which can be fed directly to a compression train (discussed more fully below in relation to FIG. 4). In the tower 27, the hydrocarbon fraction 26 is fractionated into a pyrolysis gasoline fraction 30, typically having a final boiling point of 400 to 446° F. (200 to 230° C.) and a steam cracked gas oil fraction 31, typically having a final boiling point of 500 to 1004° F. (260 to 540° C.).

Figure 2:
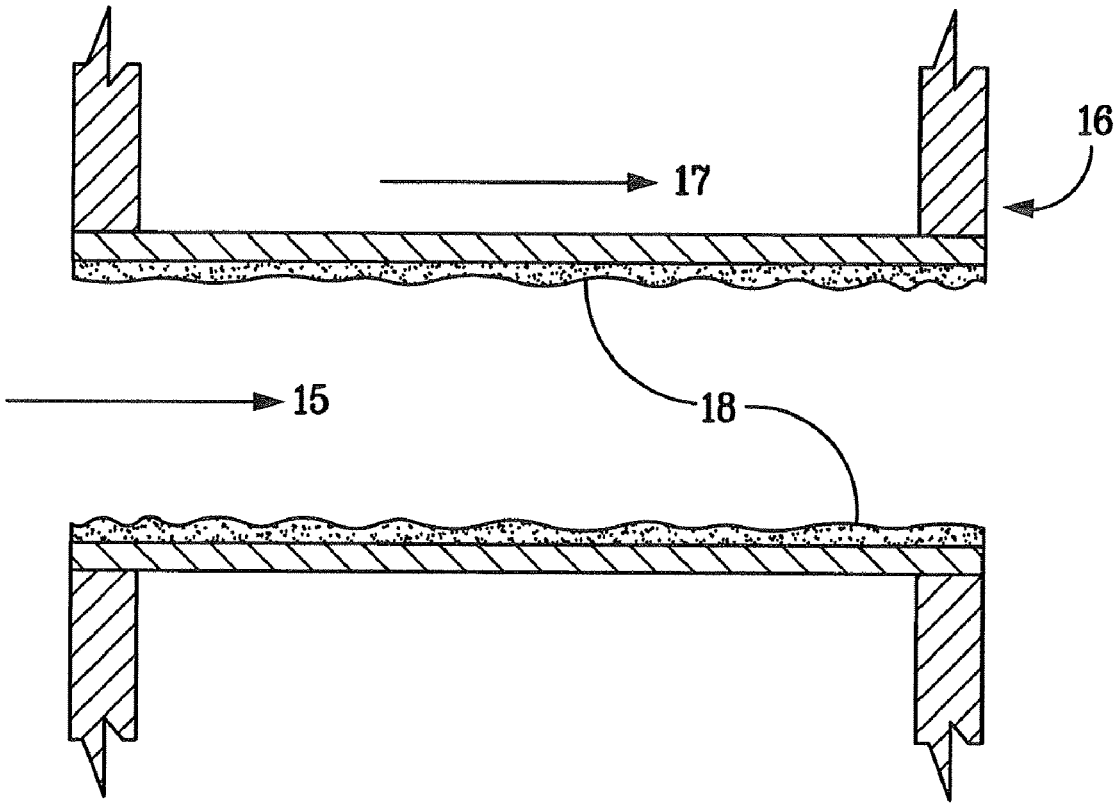
FIG. 2 is a sectional view of one tube of a secondary, or "wet," heat exchanger employed in the method shown in FIG. 1.

Referring now to FIG. 2, in a preferred embodiment of the method shown in FIG. 1, the gaseous effluent stream 15 from the primary heat exchanger 14 is cooled by passage through a secondary heat exchanger 16 before entering the tar knock-out drum 20 (see FIG. 1). In the secondary heat exchanger 16, the effluent is cooled to about 446° F. (230° C.) on the tube side of the heat exchanger while boiler feed water 17 is preheated from about 261° F. (127° C.) to about 410° F. (210° C.) on the shell side of the heat exchanger. In this way, the heat exchange surfaces of the heat exchanger 16 are cool enough to generate a liquid film 18 in situ at the surface of the tube, the liquid film resulting from condensation of the gaseous effluent.

While FIG. 2 depicts co-current flow of the gaseous effluent stream 15 and boiler feed water 17 to minimize the temperature of the liquid film 18 at the process side inlet; other arrangements of flow are possible, including countercurrent flow. Because heat transfer is rapid between the boiler feed water and the tube metal, the tube metal is just slightly hotter than the boiler feed water at any point in the heat exchanger 16. Heat transfer is also rapid between the tube metal and the liquid film 18 on the process side, and therefore the film temperature is just slightly hotter than the tube metal temperature at any point in the heat exchanger 16. Along the entire length of the heat exchanger 16, the film temperature is below about 446° F. (230° C.), the temperature at which tar is produced from this particular feed at these conditions. This ensures that the film is completely fluid, and thus fouling is avoided.

Preheating high pressure boiler feed water in the heat exchanger 16 is one of the most efficient uses of the heat generated in the pyrolysis unit. Following deaeration, boiler feed water is typically available at about 261° F. (127° C.). Boiler feed water from the deaerator can therefore be preheated in the wet transfer line heat exchanger 16 and thereafter sent to the at least one primary transfer line heat exchanger 14. All of the heat used to preheat boiler feed water will increase high pressure steam production.

The hardware for the at least one secondary heat exchanger 16 may be similar to that of a secondary heat exchanger often used in gas cracking service. A shell and tube exchanger could be used. The process stream could be cooled on the tube side in a single pass, fixed tubesheet arrangement. A relatively large tube diameter would allow coke produced upstream to pass through the exchanger without plugging. The design of the heat exchanger 16 may be arranged to maximize thickness of the liquid film 18, for example, by adding fins to the outside surface of the heat exchanger tubes. Also, boiler feed water could be preheated on the shell side in a single pass arrangement. Alternatively, the shell side and tube side services could be switched. Either co-current or counter-current flow could be used, provided that the film temperature is kept low enough along the length of the exchanger.

Alternatively, the hardware for the secondary heat exchanger may be similar to that of a close coupled primary heat exchanger. A tube-in-tube exchanger could be used. The process stream could be cooled in the inner tube. A relatively large inner tube diameter would allow coke produced upstream to pass through the exchanger without plugging. Boiler feed water could be preheated in the annulus between the outer and inner tubes. Either co-current or counter-current flow could be used, provided that the film temperature is kept low enough along the length of the exchanger. The secondary heat exchanger could be designed to allow decoking using steam or a mixture of steam and air in conjunction with the furnace decoking system.

The secondary heat exchanger may be oriented such that the process flow is either horizontal, vertical upflow, or, preferably, substantially vertical downflow. A substantially vertical downflow system helps ensure that the liquid film formed in situ remains generally uniform over the entire inside surface of the heat exchanger tube, thereby minimizing fouling. In contrast, in a horizontal orientation the liquid film will tend to be thicker at the bottom of the heat exchanger tube and thinner at the top because of the effect of gravity. In a vertical upflow arrangement, the liquid film may tend to separate from the tube wall as gravity tends to pull the liquid film downward. Another practical reason favoring a vertical downflow orientation is that the inlet stream exiting the primary heat exchanger is often located high up in the furnace structure, while the outlet stream is desired at a lower elevation. A downward flow secondary heat exchanger would naturally provide this transition in elevation for the stream.

The secondary heat exchanger may be designed to allow decoking of the exchanger using steam or a mixture of steam and air in conjunction with the furnace decoking system. When the furnace is decoked, using either steam or a mixture of steam and air, the furnace effluent would first pass through the primary heat exchanger and then through the secondary heat exchanger prior to being disposed of to the decoke effluent system. With this feature, it is advantageous for the inside diameter of the secondary heat exchanger tubes to be greater than or equal to the inside diameter of the primary heat exchanger tubes. This ensures that any coke present in the effluent of the primary heat exchanger will readily pass through the secondary heat exchanger tubes without causing any restrictions.

Figure 3:
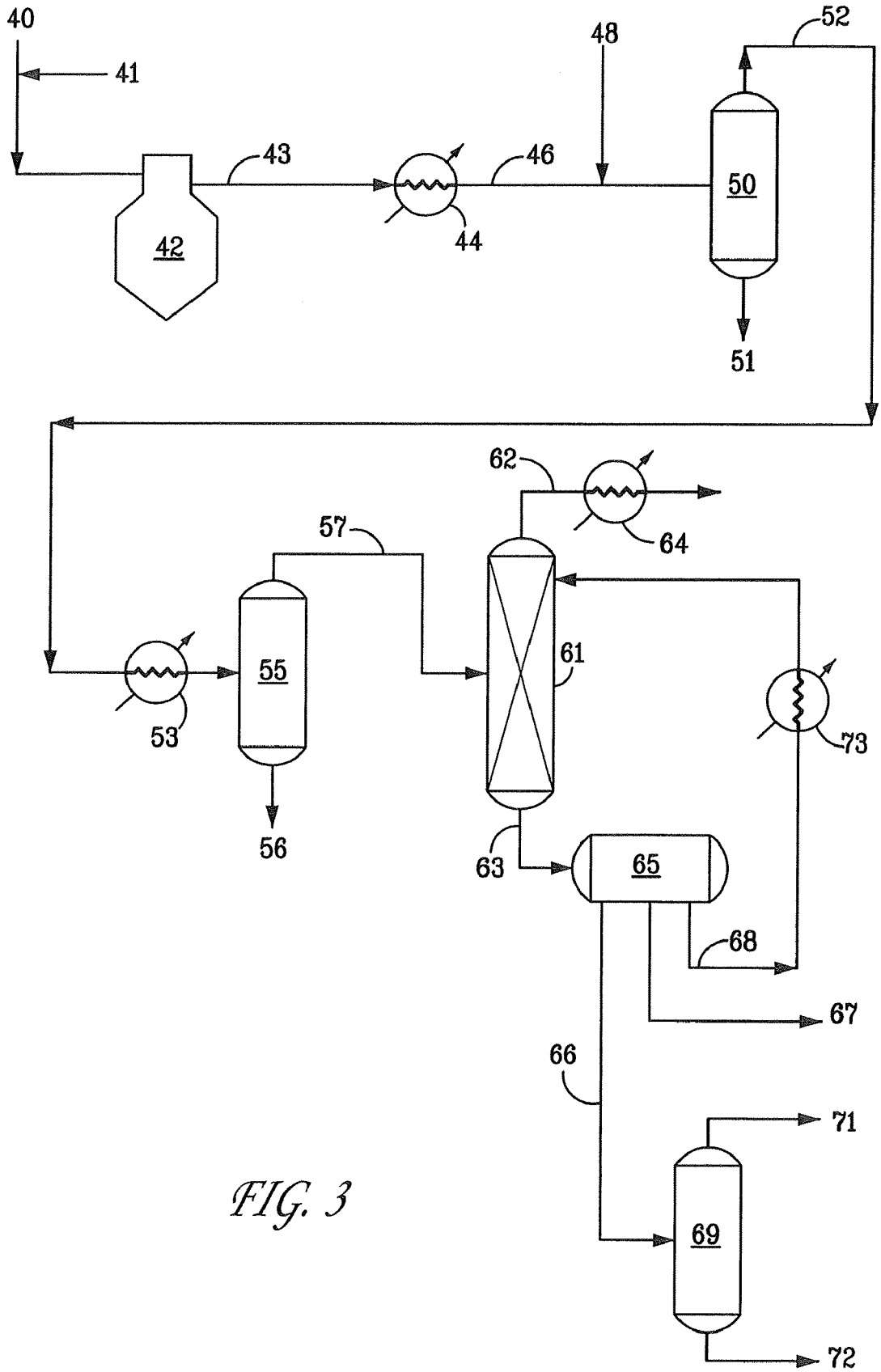
FIG. 3 is a schematic flow diagram of a method according to a second example of the present invention of treating the gaseous effluent from the liquid cracking of a gas oil feed.

Referring now to FIG. 3, the method of the second example is intended for use in the treatment of the effluent from the steam cracking of heavier feeds than naphthas, such as gas oils. In this second example, a feed 40 comprising gas oil and dilution steam 41 is fed to a steam cracking reactor 42 where the hydrocarbon feed is heated to cause thermal decomposition of the feed to produce lower molecular weight hydrocarbons, such as $C_2$-$C_4$ olefins.

As in the first example, the gaseous pyrolysis effluent 43 exiting the reactor 42 is initially passed through at least one primary heat exchanger 44, which cools the effluent 43 to a temperature above its hydrocarbon dew point. However, since the feed is heavier, the hydrocarbon dew point of the effluent 43 is higher than with a naphtha feed and hence the heat exchanger 44 typically cools the effluent to a temperature between about 896° F. (480° C.) and about 1256° F. (680° C.), such as about 1004° F. (540° C.).

After leaving the primary heat exchanger 44, the effluent stream 46 is cooled to a temperature at which the tar in the effluent condenses. This cooling may involve passing the effluent through a secondary wet transfer line heat exchanger, as in the first example, but more preferably is achieved by means of an oil quench point 48. After oil quenching, the effluent is passed into at least one tar knock-out drum 50 where the effluent is separated into a tar and coke fraction 51 and a gaseous fraction 52.

Thereafter, the gaseous fraction 52 passes through one or more cracked gas coolers 53, where the fraction is cooled to a temperature of about 200° F. to about 302° F. (90° C. to about 150° C.), such as about 248° F. (120° C.). The cooled gaseous fraction is then passed into at least one secondary oil knock-out drum 55, where light oil fraction 56 is separated from the effluent stream and is removed for further processing, e.g., by means of a pyrolysis gasoline distillation tower. The separation of the light oil fraction 56 not only reduces the density of the pyrolysis gasoline obtained later in the cooling sequence but also provides a source for the oil quench point 48.

The gaseous effluent 57 remaining after separation of the light oil fraction 56 is passed to a water quench tower 61, where the stream is cooled directly with water and separates into a gaseous overhead 62 and a liquid residue 63. The overhead 62 thereafter can pass through a trim cooler 64, where the overhead is further cooled to about 104° F. (40° C.) and can then be further processed, such as in the compression train shown in FIG. 4. The liquid residue 63 leaving the water quench tower 61 passes to a quench settler 65, where a pyrolysis gasoline fraction 66, a net water fraction 67 and a circulating water fraction 68 are separated. The pyrolysis gasoline fraction 66 is fed to a distillation tower 69 where it is fractionated into a steam cracked pyrolysis gasoline fraction 71 and a steam cracked gas oil fraction 72. The net water fraction 67 is fed to a sour water stripper (not shown) and the circulating water fraction 68 is passed through quench water coolers 73, where it is further cooled before being recycled to water quench tower 61.

Figure 4:
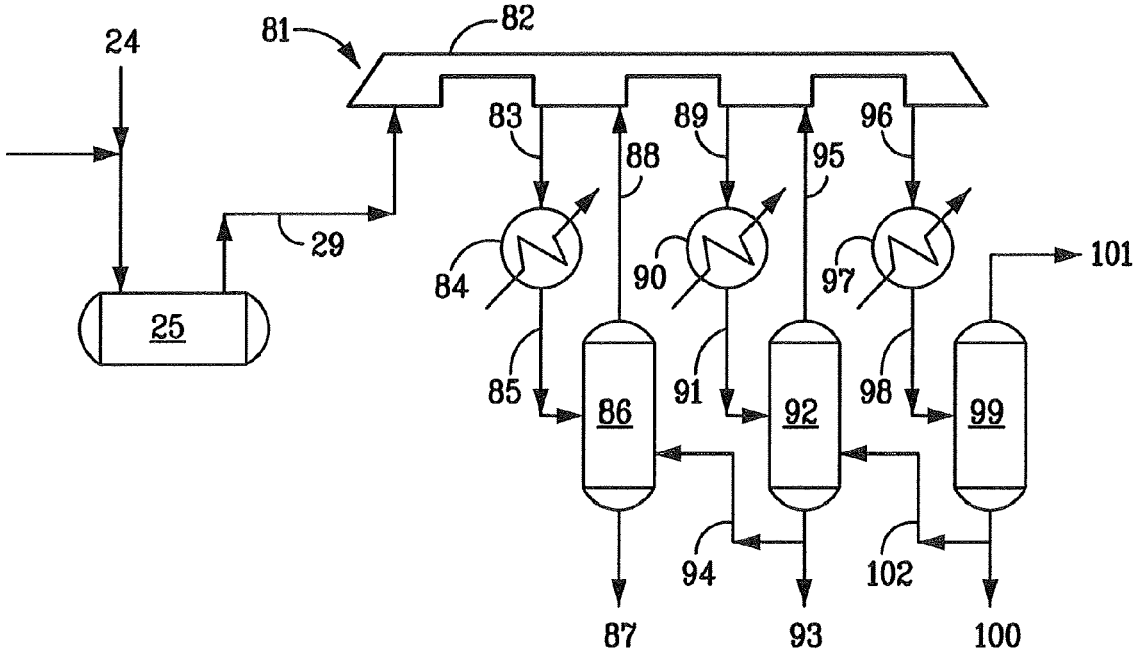
FIG. 4 is a schematic flow diagram of the compression train for compressing the light gas product of the method shown in FIG. 1.

Referring now to FIG. 4, the gaseous overhead fraction 29 from the quench water settling drum 25 contains the desired $C_2$-$C_4$ olefins and is fed to a compression train 81 which cools and condenses the $C_2$-$C_4$ olefins in the fraction 29, as well as removing any higher boiling hydrocarbons remaining after the cooling sequence shown in FIG. 1. In particular, the overhead fraction 29 is fed to the first stage of a multi-stage compressor 82 to produce a compressed vapor 83 which is then fed to a heat exchanger 84 where the vapor is cooled and partially condensed. The resultant cooled stream 85 is then sent to a drum 86 where liquid hydrocarbon 87 is separated from vapor 88. Vapor 88 is compressed further in a second stage of the multi-stage compressor 82 and the resultant second stage compressed vapor 89 is cooled and partially condensed in a heat exchanger 90. The resultant cooled stream 91 is then sent to drum 92 where liquid hydrocarbon 93 is separated from vapor 95 and may be partly or completely recycled as stream 94 to drum 86. The vapor 95 is compressed further in a third stage of the multi-stage compressor 82 and the resultant third stage compressed vapor 96 is cooled and partially condensed in heat exchanger 97. The cooled stream 98 exiting the heat exchanger 97 is sent to a drum 99 where liquid hydrocarbon 100 is separated from vapor 101 and may be partly or completely recycled as stream 102 to drum 92.

Liquid hydrocarbon streams 87, 93, and/or 100 may comprise all or a portion of the stream 24, which is added to the quench water settling drum 25 of FIG. 1 to improve the separation of liquid hydrocarbons from water. These streams are particularly well suited for this purpose because they increase the density difference between the phases without evolving significant quantities of vapor. Evolved vapor is undesirable because it must be compressed, consuming energy and capacity.

While the invention has been described in connection with certain preferred embodiments so that aspects thereof may be more fully understood and appreciated, it is not intended to limit the invention to these particular embodiments. On the contrary, it is intended to cover all alternatives, modifications and equivalents as may be included within the scope of the invention as defined by the appended claims.

The invention claimed is:

1. A hydrocarbon cracking apparatus comprising:

(a) a reactor for pyrolyzing a hydrocarbon feedstock, the reactor having an outlet through which gaseous pyrolysis effluent can exit the reactor;

(b) at least one heat exchanger connected to and downstream of the reactor outlet for cooling the gaseous effluent, wherein said at least one heat exchanger includes at least one primary transfer line heat exchanger and at least one secondary transfer line heat exchanger connected to and downstream of the reactor outlet;

(c) at least one tar knock-out drum connected to and downstream of the at least one heat exchanger for separating tar from the gaseous effluent;

(d) a cooling train comprising at least one indirect heat exchange condenser having an inlet connected to a gaseous effluent outlet of the at least one knock-out drum, without an intervening primary fractionation tower, for further cooling the gaseous effluent to less than 100° C. so as to condense a hydrocarbon fraction having a boiling point range between about 150° C. to about 540° C. from said effluent;

(e) a separator tank for removing said hydrocarbon fraction from said gaseous effluent; and (f) a fractionator downstream of said separator tank for fractionating said hydrocarbon fraction into a heavy fraction and a light fraction having a boiling point range between about 150° C. to about 230° C.

2. The apparatus as claimed in claim 1, wherein said at least one secondary transfer line heat exchanger is disposed such that heat transfer medium flows vertically downwards through said secondary exchanger.

3. The apparatus as claimed in claim 1 further including a decoking system having an inlet for a decoking medium and an outlet for coke, wherein said primary and secondary heat exchangers can be connected to said decoking system such that said decoking medium passes through said at least one primary heat exchanger and then said at least one secondary exchanger before flowing to said outlet.

4. The apparatus as claimed in claim 3, wherein said primary and secondary heat exchangers comprise heat exchange tubes and each of said heat exchange tubes of the secondary heat exchanger has an internal diameter greater than that of each of said heat exchange tubes of the primary heat exchanger.

5. The apparatus as claimed in claim 1, wherein said cooling train includes a circulation system that circulates water from said condenser to said at least one secondary heat exchanger and then to said at least one primary heat exchanger.

6. The apparatus as claimed in claim 1 including a direct quench point downstream of said at least one heat exchanger and upstream of said at least one tar knock-out drum.

7. The apparatus as claimed in claim 1, wherein said cooling train includes at least one additional knock-out drum for separating a light oil fraction from said effluent.

* * * * *

UNITED STATES PATENT AND TRADEMARK OFFICE

CERTIFICATE OF CORRECTION

PATENT NO. : 7,972,482 B2
APPLICATION NO. : 12/785758
DATED : July 5, 2011
INVENTOR(S) : Robert David Strack and John R. Messinger It is certified that error appears in the above-identified patent and that said Letters Patent is hereby corrected as shown below:

Title Page, Item (73) Assignee: should read

-- ExxonMobil Chemical Patents. Inc. --

Signed and Sealed this
Twenty-seventh Day of September, 2011

David J. Kappos

David J. Kappos
*Director of the United States Patent and Trademark Office*